US005640866A

United States Patent [19]

Satoh et al.

[11] Patent Number: 5,640,866

[45] Date of Patent: Jun. 24, 1997

[54] ROLL FOR ROLLING MILL AND ROLL-SHIFT TYPE ROLLING MILL

[75] Inventors: Kazuyuki Satoh; Hisashi Honjou; Hajime Ishi; Toshio Iwanami, all of Yokohama, Japan

[73] Assignee: Ishikawajima-Harima Heavy Industries Co., Ltd., Tokyo, Japan

[21] Appl. No.: 326,252

[22] Filed: Oct. 20, 1994

[30] Foreign Application Priority Data

Feb. 25, 1994 [JP] Japan ..... 6-027085

[51] Int. Cl.[6] ..... B21B 27/02

[52] U.S. Cl. ..... 72/12.7; 72/247; 72/252.5; 492/28

[58] Field of Search ..... 72/199, 245, 247, 72/252.5, 12.7; 492/1, 3, 28

[56] References Cited

U.S. PATENT DOCUMENTS

| | | | |
|---|---|---|---|
| 4,400,957 | 8/1983 | Carlstedt et al. | 72/247 |
| 4,440,012 | 4/1984 | Feldmann et al. | 72/201 |
| 4,881,396 | 11/1989 | Seldel et al. | 72/247 |

FOREIGN PATENT DOCUMENTS

| | | | |
|---|---|---|---|
| 47-32907 | 8/1972 | Japan | 72/252.5 |
| 63-62283 | 12/1988 | Japan . | |
| 2198981 | 6/1988 | United Kingdom | 72/247 |

*Primary Examiner*—Lowell A. Larson

*Attorney, Agent, or Firm*—Griffin, Butler, Whisenhunt & Kurtossy

[57] ABSTRACT

A rolling mill includes a roll barrel having a straight region disposed at the middle thereof, sub-crown control regions disposed at both ends thereof, and main-crown control regions disposed between the straight region and the sub-crown control regions. The roll barrel has an outer surface having a bus bar which is a straight line inclined to a longitudinal axis of the roll barrel in the straight region, steep convex and concave curved shapes in the main-crown control regions, and gentle convex and concave curved shapes in the sub-crown control regions. The roll barrel has both ends having a diameter approximately equal to each other. The roll provides a large degree of freedom in designing curves to be applied to an outer surface of a roll barrel with the result that a larger crown control can be performed, and has a small number of factors for a vibration of a plate. The roll shift type rolling mill in accordance with the invention decreases an irregularity in plate thickness distribution at ends of a plate even when a plate having a width larger than specific maximum plate width is to be rolled.

4 Claims, 5 Drawing Sheets

ROLL FOR ROLLING MILL AND ROLL-SHIFT TYPE ROLLING MILL

BACKGROUND OF THE INVENTION

1. Field of the Invention

The invention relates to a roll shift type rolling mill for rolling a plate by alternately, axially shifting upper and lower work rolls, and more particularly to a roll for use with such a rolling mill and a roll shift type rolling mill using such a roll.

2. Description of the Related Art

FIG. 1 schematically illustrates a conventional rolling mill for obtaining a flat-shaped plate by controlling a cross-section of a rolled plate in the widthwise direction thereof. The illustrated rolling mill is known as a roll shift type rolling mill which rolls a plate 2 by alternately, axially shifting upper and lower work rolls 1. For instance, Japanese Patent Publication No. 63-62283 has suggested such a rolling mill.

However, since the work rolls 1 of a conventional roll shift type rolling mill as aforementioned have an initial crown so that a crown control effect can be brought to all plates having a width ranging from a broad one to a narrow one, a roll crown tends to be excessive and thereby tends to cause a rolling defect. In addition, the conventional rolling mill poses another problem that, since the conventional rolling mill shifts the work rolls 1 in accordance with a width of the plate 2, a specific width makes an amount of shifting of the work rolls 1 too large, and thereby causes a vibration of the plate 2.

Thus, the inventors of the present invention have invented and filed a roll for use with a rolling mill and a roll shift type rolling mill using such a roll for avoiding a rolling defect and vibration of a plate, in order to bring a crown control effect only to a plate having a specific width.

The above mentioned roll and roll shift type rolling mill was filed in Japan on Jul. 24, 1993 as a patent application No. 5-237023. This Japanese patent application is not published yet. Accordingly, the Japanese patent application does not constitute prior art under 35 U.S.C. sections 102 or 103. It should be noted that the description of the disclosure of the application as will be made hereinbelow is only for explaining the background of the invention or for making it easy to understand the invention, and that the inventors do not thereby admit that the Japanese patent application No. 5-237023 constitutes prior art against the present invention.

As illustrated in FIG. 2, a rolling mill 10 in accordance with Japanese patent application No. 5-237023 has shift rolls 12*a* and 12*b* which can be shifted in an axial direction indicated by an arrow A. A roll barrel of each of the shift rolls 12*a* and 12*b* has a straight region 7 located at the middle thereof, sub-crown control regions 6 located at both ends thereof, and main-crown control regions 5 located between the straight region 7 and the sub-crown control regions 6. The roll barrel has an outer surface having a bus bar which is a straight line inclined to a longitudinal axis of the roll barrel in the straight region 7, having steep convex and concave curved shapes at a smaller diameter end in the main-crown control regions 5, and having gentle convex and concave curved shapes at a larger diameter end in the sub-crown control regions 6.

However, since the shift rolls 12*a* and 12*b* are formed so that they have a diameter being gradually reduced in a direction from one of the sub-crown control region to the other, there is a large difference in a roll diameter in particular at both ends of the sub-crown control region 6. Such a large difference in a roll diameter tends to cause a rolling defect and vibration of the plate. Thus, the rolling mill 10 illustrated in FIG. 2 is adapted to have an inflection line of an outer surface of the roll barrel within a maximum permissible displacement determined by a rolling defect. For instance, the maximum permissible displacement is approximately 1 mm for a roll having a length of 700 mm, and it is necessary to form the roll barrel so that the roll barrel has a gradually decreasing diameter within the maximum permissible displacement and further so that the roll barrel has various curved shapes as above mentioned. Accordingly, it is impossible for the main-crown control region to have a sufficiently steep curve. For instance, it is necessary to form such a curve in a length less than one-half, one-third or one-fourth and so on of 1 mm.

In view of the foregoing, it is an object of the present invention to provide a roll for use with a rolling mill, which has a large degree of freedom in designing a curve to be applied to an outer surface of a roll barrel, provides a large amount of crown control, and has few factors for vibrating the plate.

The rolling mill 10 illustrated in FIG. 2 can accomplish a desired crown control effect for a plate having a width equal to or smaller than a specific maximum plate width. However, in the case of rolling a plate having a width larger than the maximum plate width, there arises a problem that an irregularity is generated in plate thickness distribution at the ends of the plate. Specifically, as illustrated in FIG. 3A, when the upper shift roll 12*a* is shifted to the right and the lower shift roll 12*b* is shifted to the left (hereinbelow, such shifting is called "INC shift"), a concave crown control wherein a middle portion of a rolled plate is made concave can be accomplished. However, in such a concave crown control, there arises an irregularity wherein plate ends are formed thinner, when a plate having a width larger than specific maximum plate width is to be rolled. On the other hand, as illustrated in FIG. 3B, when the upper shift roll 12*a* is shifted to the left and the lower shift roll 12*b* is shifted to the right (hereinbelow, such shifting is called "DEC shift"), a convex crown control wherein a middle portion of a rolled plate is made convex can be accomplished. However, in such a convex crown control, there arises an irregularity wherein plate ends are formed thicker (such an irregularity is called "a quarter extension"), when a plate having a width larger than specific maximum plate width is to be rolled.

In view of the foregoing, another object of the present invention is to provide a roll shift type rolling mill which decreases irregularity in the plate thickness distribution at the ends of the plate even when a plate having a width larger than specific maximum plate width is to be rolled.

SUMMARY OF THE INVENTION

In one aspect, the invention provides a rolling mill including a roll barrel which has a straight region disposed at the middle thereof, sub-crown control regions disposed at both ends thereof, and main-crown control regions disposed between the straight region and the sub-crown control regions. The roll barrel has an outer surface having a bus bar which is a straight line inclined to a longitudinal axis of the roll barrel in the straight region, having steep convex and concave curved shapes in the main-crown control regions, and having gentle convex and concave curved shapes in the sub-crown control regions. The roll barrel has both ends having a diameter approximately equal to each other.

In a preferred embodiment, a parabolic shape for compensating for roll heat crown and roll deflection is added to the convex and concave curved shapes in the main-crown and sub-crown control regions.

In another aspect, the invention provides a roll shift type rolling mill including a pair of work rolls capable of carrying out roll bend, for rolling a workpiece, a pair of shift rolls in contact with the pair of work rolls and capable of axially being shifted, and a controller for controlling amounts of roll bend of the work rolls and shift of the shift rolls in accordance with data about width of the workpiece. The controller determines a degree of roll bend so that ends of the work rolls are outwardly bent during concave crown control by which a middle portion of a workpiece is made concave, and so that ends of the work rolls are inwardly bent during convex crown control by which a middle portion of a workpiece is made convex.

In a preferred embodiment, the controller includes an operation circuit for calculating correction values for ends and a middle portion of a barrel in accordance with the data.

The advantages obtained by the aforementioned present invention will be described hereinbelow.

In the roll for use with a rolling mill in accordance with the invention, the straight region is a straight line inclined to a longitudinal axis of a barrel and the roll barrel has both ends having a diameter approximately equal to each other. Hence, there is scarcely a difference in roll diameter in the sub-crown control regions at both ends of the roll barrel, and thus it is possible to significantly reduce vibration of the plate. In addition, since there is scarcely a difference in roll diameter in the sub-crown control regions at both ends of the roll barrel, a maximum permissible displacement determined by generation of a rolling defect can be used in forming the convex and concave curved shapes. Thus, it is possible to form curved shapes in the main-crown control regions to be sufficiently steep, and hence a large degree of freedom can be obtained in designing curves to be applied to an outer surface of the roll barrel with the result that larger crown control can be performed. Furthermore, the compensation of the curved shapes of the regions with values based on roll heat crown and roll deflection ensures rolling a plate having a high precision in shape.

The roll shift type rolling mill in accordance with the invention carries out the concave crown control to a middle portion of the barrel with shift rolls having main-crown control regions, and makes a correction to ends of the barrel with a roll bend, to thereby make it possible to control a shape of a plate to be rolled over an entire width and thus provide a rolled plate having a uniform thickness distribution. The roll bend exerts a little effect to a middle portion of the barrel, while the roll bend exerts a large effect to the ends of the barrel. Thus, the degree of roll bend is determined using the above mentioned property of the roll bend so that the roll ends are outwardly bent during the concave crown control, while the roll ends are inwardly bent during the convex crown control. The determination of the degree of roll bend in such a way ensures that plate ends are formed thicker by INC bend to thereby reduce an irregularity at plate ends in INC shift, while plate ends are formed thinner by DEC bend to thereby reduce an irregularity at plate ends in DEC shift.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENT

A preferred embodiment in accordance with the present invention will be explained hereinbelow with reference to drawings.

Figure 1:
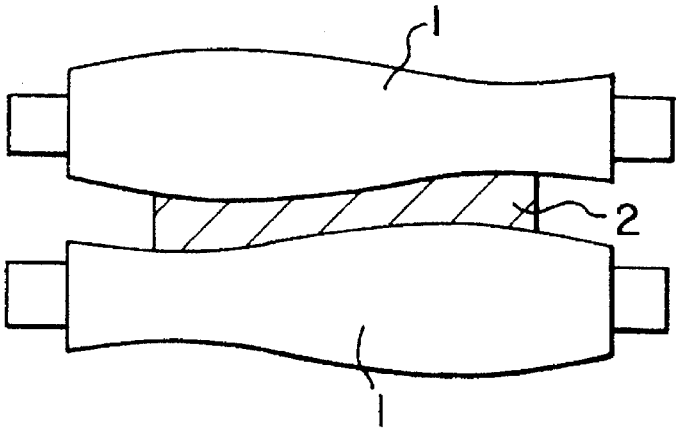
FIG. 1 PRIOR ART
FIG. 1 is a schematic view illustrating a conventional roll shift type rolling mill.
Figure 2:
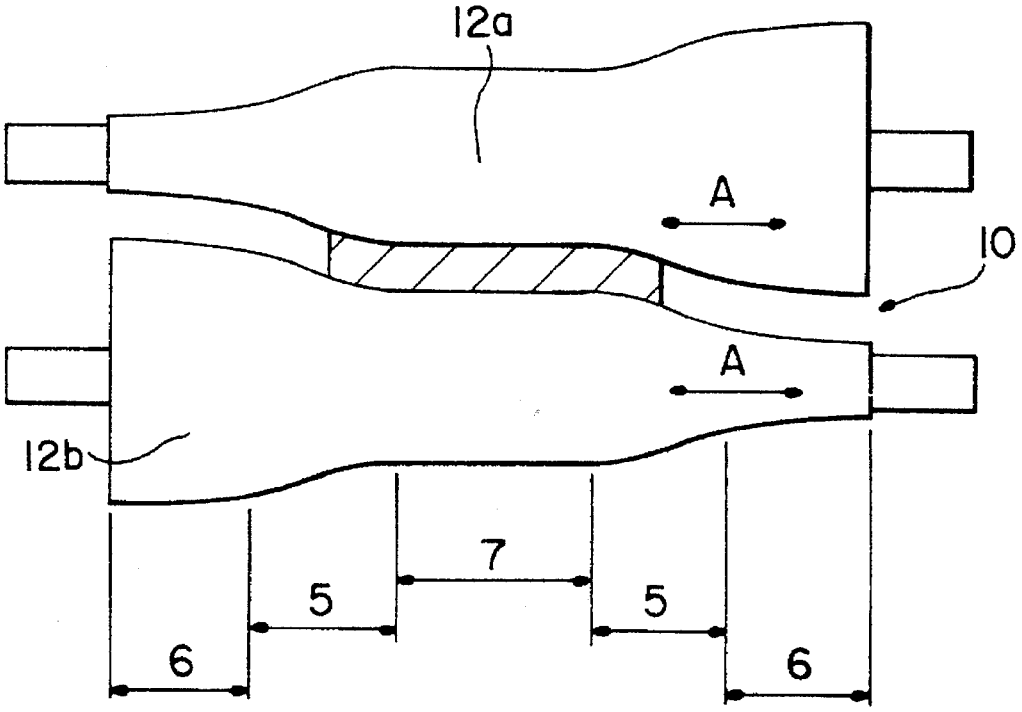
FIG. 2 is a schematic view illustrating a rolling mill invented by the inventors of the present invention.
Figure 3A:
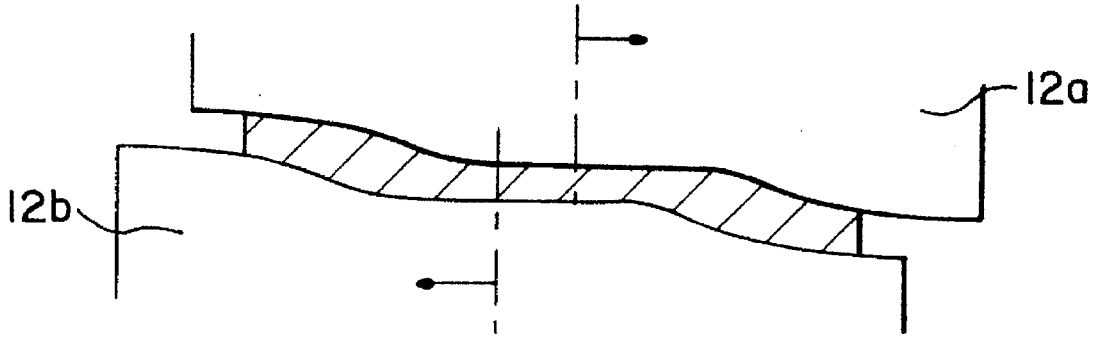
FIGS. 3A and 3B show crown control effects generated by the roll barrel illustrated in FIG. 2.
Figure 3B:
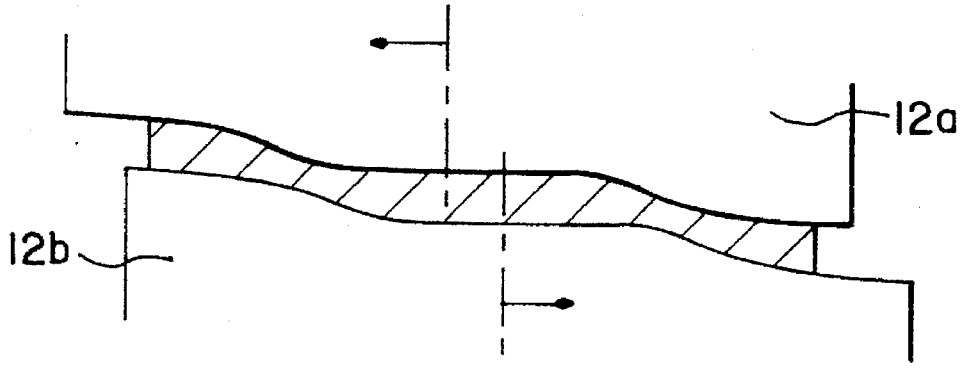
Figure 4:
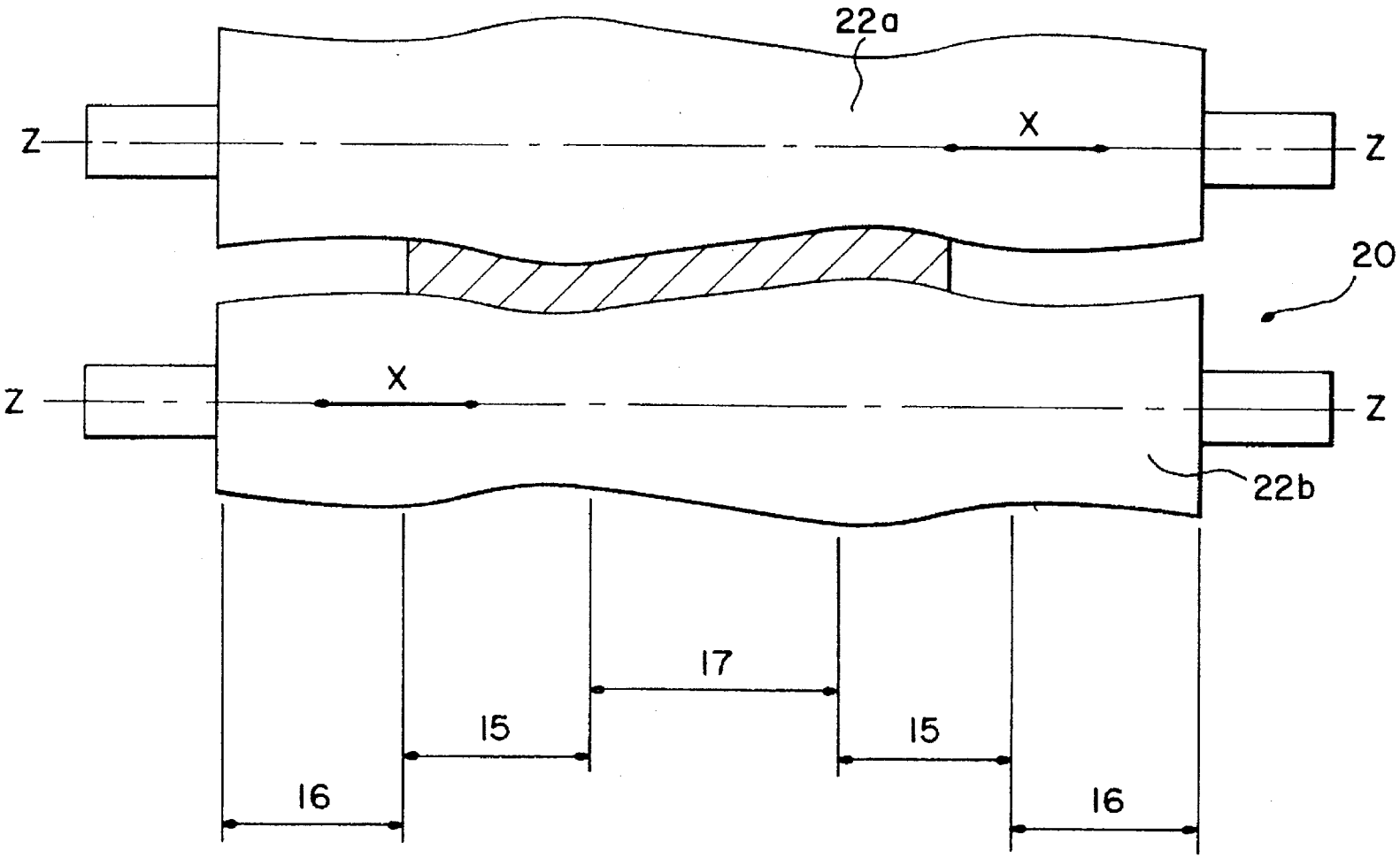
FIG. 4 is a schematic view illustrating a rolling mill using a roll in accordance with the invention.

FIG. 4 schematically illustrates a roll in accordance with the invention, for use with a rolling mill. An illustrated roll in accordance with the invention is used with a roll shift type rolling mill 20, and comprises a pair of upper and lower shift rolls **22*a* and 22 which can be shifted in an axial direction indicated by an arrow X. Each of the shift rolls 22*a* and 22*b* has a roll barrel having a straight region 17 located at the middle thereof, sub-crown control regions 16 located at both ends thereof, and main-crown control regions 15 located between the straight region 17 and the sub-crown control regions 16. The roll barrel has an outer surface having a bus bar which is a straight line inclined to a longitudinal axis of the roll barrel in the straight region 17, steep convex and concave curved shapes in the main-crown control regions 15, and gentle convex and concave curved shapes in the sub-crown control regions 16**. The roll barrel has both ends having a diameter approximately equal to each other.

Since the straight region 17 is a straight line inclined to a longitudinal axis of the barrel and the both ends of the barrel have equal diameters, there is scarcely a difference in roll diameter in the sub-crown control regions 16, and thereby it is possible to significantly reduce vibration of the plate during rolling. In addition, since there is scarcely a difference in roll diameter in the sub-crown control regions 16 at both ends of the roll barrel, a maximum permissible displacement determined by generation of a rolling defect can be used in forming the convex and concave curved shapes. Thus, it is possible to form curved shapes in the main-crown control regions 15 to be sufficiently steep, and hence a large degree of freedom can be obtained in designing curves to be applied to an outer surface of the roll barrel with the result that larger crown control can be performed. The roll in accordance with the invention for use with a rolling mill has sub-crown control regions 16 located outwardly from the main-crown control regions 15, and accordingly can exert a crown control effect to ends of a plate width even when a plate to be rolled has an increased width.

Furthermore, the compensation of the curved shapes of the regions with values based on roll heat crown and roll deflection is preferable. Such a compensation ensures a rolled plate having a higher precision in shape.

Figure 5:
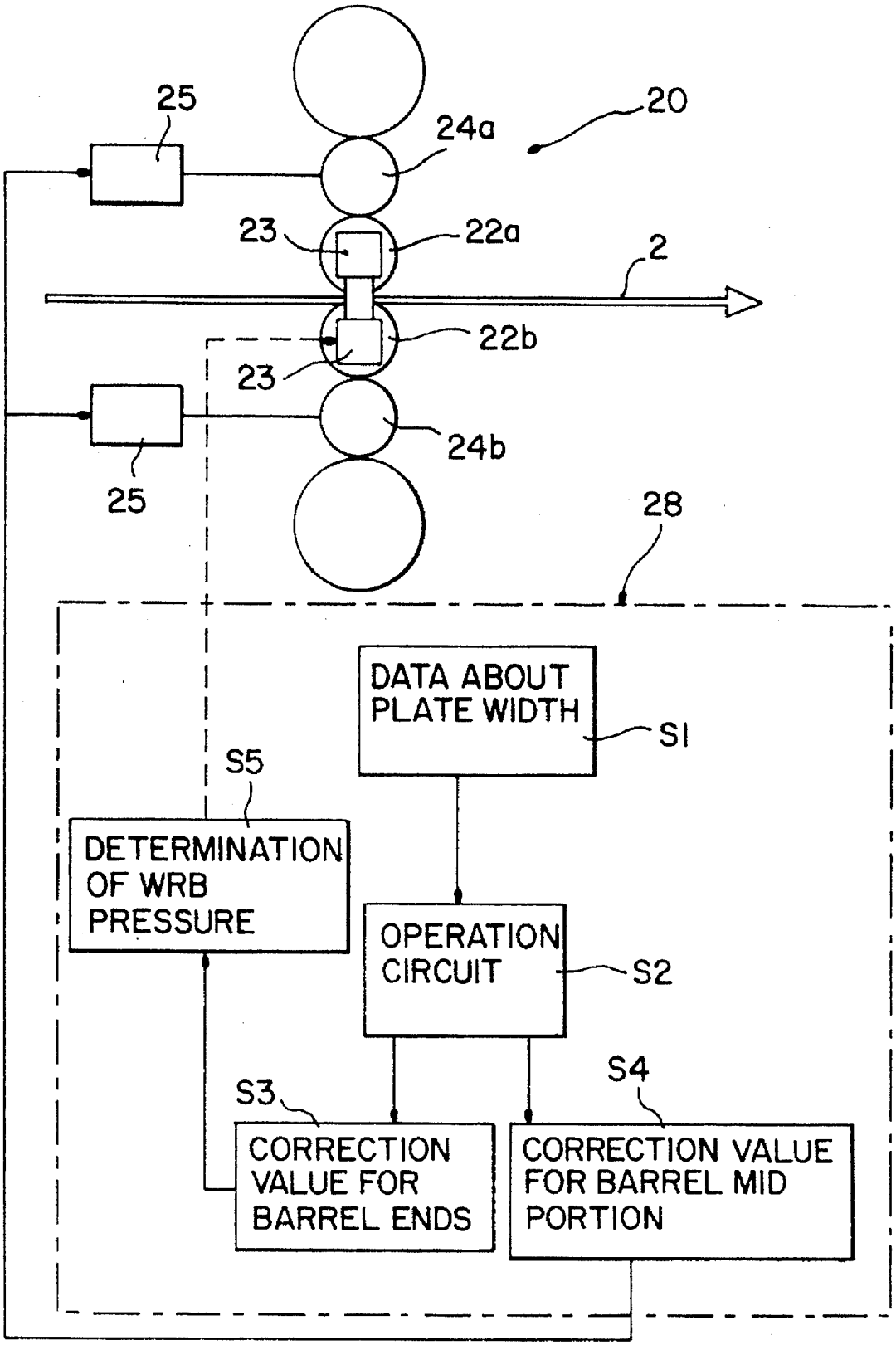
FIG. 5 is a schematic view illustrating a roll shift type rolling mill in accordance with the invention.

FIG. 5 schematically illustrates a roll shift type rolling mill in accordance with the invention. The rolling mill 20 includes a pair of work rolls **22*a* and 22*b* for rolling a plate end capable of performing roll bend, a pair of shift rolls 24*a* and 24*b* in contact with the work rolls 22*a* and 22*b* and capable of being axially shifted, and a controller 28 for controlling the roll bend of the work rolls 22***a* and 22*b* and the axial shift length of the shift rolls 24*a* and 24*b* in accordance with data regarding the width of a plate to be rolled. The work rolls 22*a* and 22*b* preferably comprise the work rolls illustrated in FIG. 4.

To the ends of the work rolls 22*a* and 22*b* are connected hydraulic cylinders 23. The roll bend can be adjusted by controlling an amount of fluid to be supplied to the hydraulic cylinders 23. To the ends of the shift rolls 24*a* and 24*b* are connected hydraulic cylinders 25 for axially shifting the shift rolls 24*a* and 24*b*. The hydraulic cylinders 25 control the position of the shift rolls 24*a* and 24*b* to thereby control the amount of shift of the shift rolls 24*a* and 24*b*.

The controller 28 includes an operation circuit S2 which calculates a correction value S3 for barrel ends and a correction value S4 for a middle portion of a barrel in accordance with data S1 about a width of a plate. The controller 28 determines the degree of roll bend so that roll ends are outwardly bent during a concave crown control wherein a middle portion of a plate is formed to be concave, and so that roll ends are inwardly bent during a convex crown control wherein a middle portion of a plate is formed to be convex. In other words, the controller 28 determines a pressure (S5) for work roll bend (WRB) in accordance with the correction value S3 for barrel ends, and thereby controls a hydraulic pressure to be supplied to the hydraulic cylinders 23 to establish a roll bend of the work rolls 22*a* and 22*b*, and carries out a position control to the hydraulic cylinders 25 in accordance with the correction value S4 for a middle portion of a barrel to thereby establish a shift amount of the shift rolls 24*a* and 24*b*.

Figure 6A:
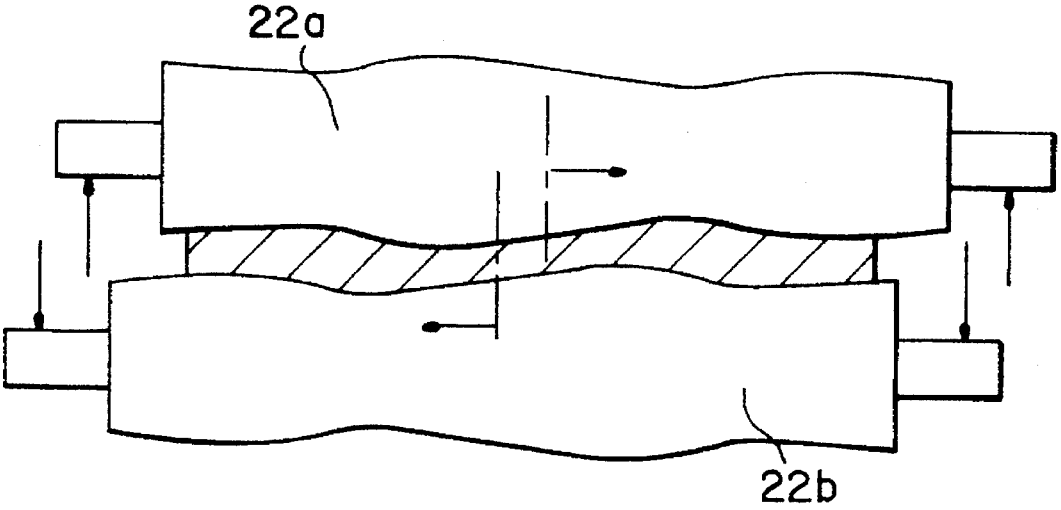
FIGS. 6A and 6B show crown control effects generated by a roll barrel in accordance with the invention.
Figure 6B:
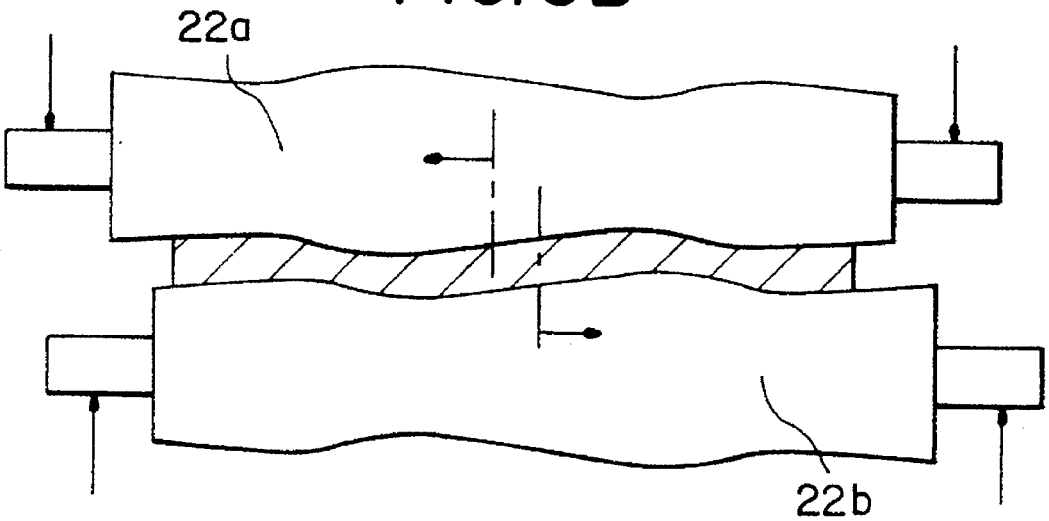

The roll shift type rolling mill in accordance with the invention carries out the concave crown control to a middle portion of the barrel with the shift rolls 24*a* and 24*b* having the main-crown control regions 15, and makes a correction to the ends of the barrel with a roll bend, to thereby make it possible to control a shape of a plate to be rolled over an entire width and thus provide a rolled plate having a uniform thickness distribution. The roll bend exerts a little effect thereof to a middle portion of the barrel, while the roll bend exerts a large effect thereof to the ends of the barrel. Thus, the degree of roll bend is determined using the above mentioned property of the roll bend so that the roll ends are outwardly bent during the concave crown control, while the roll ends are inwardly bent during the convex crown control. As illustrated in FIGS. 6A and 6B, the determination of the degree of roll bend in such a way ensures that plate ends are formed thicker by INC bend to thereby reduce an irregularity at plate ends in INC shift, while plate ends are formed thinner by DEC bend to thereby reduce an irregularity at plate ends in DEC shift.

Specifically, as illustrated in FIG. 6A, when the upper shift roll 22*a* is shifted to the right and the lower shift roll 22*b* is shifted to the left, a concave crown control wherein a middle portion of a rolled plate is made concave can be accomplished. In such a concave crown control, when a plate having a width larger than specific maximum plate width is to be rolled, the plate ends are formed thicker by INC bend in INC shift to thereby make it possible to reduce an irregularity wherein plate ends are formed thinner. Similarly, as illustrated in FIG. 6B, when the upper shift roll 22*a* is shifted to the left and the lower shift roll 22*b* is shifted to the right, a convex crown control wherein a middle portion of a rolled plate is made convex can be accomplished. In such a convex crown control, when a plate having a width larger than specific maximum plate width is to be rolled, the plate ends are formed thinner by DEC bend in DEC shift to thereby make it possible to reduce an irregularity (a quarter extension) wherein plate ends are formed thicker.

Since there is scarcely a difference in roll diameter in the sub-crown control regions at both ends of the roll barrel, the roll in accordance with the invention for use with a rolling mill can significantly reduce vibration of the plate.

In addition, since a maximum permissible displacement determined by a generation of a rolling defect can be used in forming the convex and concave curved shapes, it is possible to form an inflection line in the main-crown control regions to be sufficiently steep, and hence a large degree of freedom can be obtained in designing curves to be applied to an outer surface of the roll barrel with the result that a larger crown control can be performed.

The roll shift type rolling mill in accordance with the invention can control a shape of a plate to be rolled over an entire width thereof, and hence can provide a rolled plate 5 having a uniform thickness distribution. In addition, in INC shift, INC bend forms plate ends to be thicker, while, in DEC shift, DEC bend forms plate ends to be thinner, to thereby make it possible to reduce an irregularity at the plate ends.

Thus, as mentioned so far, the roll in accordance with the invention for use with a rolling mill has many advantages such as providing a large degree of freedom in designing curves to be applied to an outer surface of a roll barrel with the result that a larger crown control can be performed, and having a small number of factors for a vibration of a plate. The roll shift type rolling mill in accordance with the invention has an advantage of decreasing an irregularity in plate thickness distribution at ends of a plate even when a plate having a width larger than specific maximum plate width is to be rolled.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A rolling mill comprising a roll barrel, said roll barrel having a longitudinal axis, two ends and a middle, a straight region disposed at the middle, sub-crown control regions disposed at each end, and main-crown control regions disposed between said straight region and said sub-crown control regions, said roll barrel having an outer surface having a bus bar which is a straight line inclined to the longitudinal axis of said roll barrel in said straight region, having steep convex and concave curved shapes in said main-crown control regions, and having gentle convex and concave curved shapes in said sub-crown control regions, and each end of said roll barrel having an approximately equal diameter.

2. The rolling mill in accordance with claim 1, wherein a parabolic shape for compensating for roll heat crown and roll deflection is added to said convex and concave curved shapes in said main-crown and sub-crown control regions.

3. A rolling mill, in accordance with claim 1, comprising:

a pair of work rolls, comprising the roll barrels of claim 1, and capable of carrying out roll bend, for rolling a workpiece;

a pair of shift rolls in contact with said pair of work rolls and capable of axially being shifted; and a controller for controlling amounts of roll bend of said work rolls and shift of said shift rolls in accordance with data about a width of said workpiece, said controller determining a degree of roll bend so that ends of said work rolls are outwardly bent during concave crown control by which a middle portion of a workpiece is made concave, and so that ends of said work rolls are inwardly bent during convex crown control by which a middle portion of a workpiece is made convex.

4. The roll shift type rolling mill in accordance with claim 3, wherein said controller includes an operation circuit for calculating correction values for ends and a middle portion of a barrel in accordance with said data.

* * * * *